US010262497B2

(12) United States Patent
Aoki et al.

(10) Patent No.: US 10,262,497 B2
(45) Date of Patent: Apr. 16, 2019

(54) WAGERING GAME HAVING INTERLINKED PROGRESSIVE VALUES WITH SHARED INCREMENT

(71) Applicant: Bally Gaming, Inc., Las Vegas, NV (US)

(72) Inventors: Dion K. Aoki, Chicago, IL (US); Michael W. Mastropietro, River Forest, IL (US); Jeffry L. Nauman, Yorkville, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/972,785

(22) Filed: May 7, 2018

(65) Prior Publication Data

US 2018/0253942 A1 Sep. 6, 2018

Related U.S. Application Data

(63) Continuation of application No. 14/494,846, filed on Sep. 24, 2014, now Pat. No. 9,990,804.

(51) Int. Cl.
*G07F 17/32* (2006.01)

(52) U.S. Cl.
CPC ..... *G07F 17/3258* (2013.01); *G07F 17/326* (2013.01)

(58) Field of Classification Search
CPC ..... G07F 17/326; G07F 17/3258
See application file for complete search history.

(56) References Cited

U.S. PATENT DOCUMENTS 4,624,459 A 11/1986 Kaufman
4,837,728 A 6/1989 Barrie et al.
(Continued)

FOREIGN PATENT DOCUMENTS

CA 2334546 A1 8/2001
DE 19515983 A1 11/1996
(Continued)

OTHER PUBLICATIONS

"New '97 Games," International Gaming & Wagering Business, 24 pages (Mar. 1997).
(Continued)

*Primary Examiner* — Jasson H Yoo
(74) *Attorney, Agent, or Firm* — Michael Blankstein; David J. Bremer

(57) ABSTRACT

A gaming system is primarily dedicated to playing a regulated casino wagering game providing eligibility to a plurality of progressive jackpots. The gaming system comprises a secure gaming cabinet, an electronic display device, an electronic input device, a random element generator, and game-logic circuitry. The game-logic circuitry is configured to allocate a portion of the wager to at least one of a first group of progressive jackpots, direct the electronic display device to increment the value of the first group of progressive jackpots, and direct the electronic display device to increment the values of a second group progressive jackpots based on the values of the first group of progressive jackpots. And, in response to a progressive-triggering outcome, the game-logic circuitry directs the electronic display device to display a reset value for the awarded progressive jackpot and an altered reduced value for another one of the progressive jackpots.

17 Claims, 13 Drawing Sheets

(56) References Cited

U.S. PATENT DOCUMENTS 4,861,041 A 8/1989 Jones et al.
4,948,134 A 8/1990 Suttle et al.
5,116,055 A 5/1992 Tracy
5,249,800 A 10/1993 Hilgendorf et al.
5,275,400 A 1/1994 Weingardt et al.
5,280,909 A 1/1994 Tracy
5,344,144 A 9/1994 Canon
5,377,973 A 1/1995 Jones et al.
5,393,057 A 2/1995 Marnell
5,417,430 A 5/1995 Breeding
5,524,888 A 6/1996 Heidel
5,544,892 A 8/1996 Breeding
5,564,700 A 10/1996 Celona
5,577,959 A 11/1996 Takemoto et al.
5,580,063 A 12/1996 Edwards
5,580,309 A 12/1996 Piechowiak et al.
5,611,730 A 3/1997 Weiss
5,645,486 A 7/1997 Nagao et al.
5,647,592 A 7/1997 Gerow
5,655,961 A 8/1997 Acres et al.
5,766,076 A 6/1998 Pease et al.
RE35,864 E 7/1998 Weingardt
5,779,549 A 7/1998 Walker et al.
5,816,918 A 10/1998 Kelly et al.
5,820,459 A 10/1998 Acres et al.
5,823,874 A 10/1998 Adams
5,839,956 A 11/1998 Takemoto
5,848,932 A 12/1998 Adams
5,851,147 A 12/1998 Stupak et al.
5,855,515 A 1/1999 Pease et al.
5,876,284 A 3/1999 Acres et al.
5,885,158 A 3/1999 Torango et al.
5,941,773 A 8/1999 Harlick
5,944,606 A 8/1999 Gerow
5,951,011 A 9/1999 Potter et al.
6,007,427 A 12/1999 Wiener et al.
6,012,982 A 1/2000 Piechowiak et al.
6,032,955 A 3/2000 Luciano et al.
6,047,963 A 4/2000 Pierce et al.
6,089,977 A 7/2000 Bennett
6,089,980 A 7/2000 Gauselmann
6,102,474 A 8/2000 Daley
6,102,799 A 8/2000 Stupak
6,110,043 A 8/2000 Olsen
6,139,013 A 10/2000 Pierce et al.
6,142,872 A 11/2000 Walker et al.
6,146,273 A 11/2000 Olsen
6,155,925 A 12/2000 Giobbi et al.
6,158,741 A 12/2000 Koelling
6,159,097 A 12/2000 Gura
6,203,010 B1 3/2001 Jorasch et al.
6,206,374 B1 3/2001 Jones
6,206,782 B1 3/2001 Walker et al.
6,517,433 B2 2/2003 Loose et al.
6,520,855 B2 2/2003 Demar et al.
6,577,733 B1 6/2003 Charrin
6,589,115 B2 7/2003 Walker et al.
6,592,458 B1 7/2003 Ho
6,592,460 B2 7/2003 Torango
6,599,186 B1 7/2003 Walker et al.
6,599,188 B2 7/2003 Hirsch et al.
6,599,193 B2 7/2003 Baerlocher et al.
6,601,771 B2 8/2003 Charrin
6,648,762 B2 11/2003 Walker et al.
6,656,052 B2 12/2003 Abramopoulos et al.
6,676,513 B2 1/2004 Gauselmann
6,702,674 B1 3/2004 De Bruin et al.
6,712,695 B2 3/2004 Mothwurf et al.
6,733,390 B2 5/2004 Walker et al.
6,776,715 B2 8/2004 Price
6,796,904 B2 9/2004 Yoseloff
6,887,154 B1 5/2005 Luciano, Jr. et al.
6,890,259 B2 5/2005 Breckner et al.
7,004,466 B2 2/2006 Gauselmann
7,036,012 B2 4/2006 Charrin
7,056,215 B1 6/2006 Olive
7,077,746 B2 7/2006 Torango
7,481,430 B1 1/2009 Jackson et al.
7,614,948 B2 11/2009 Saffari et al.
7,744,462 B2 * 6/2010 Grav ..... G07F 17/3258 463/27
7,980,947 B2 7/2011 Michaelson et al.
8,070,606 B2 12/2011 Rowan et al.
8,506,391 B2 8/2013 Jaffe et al.
8,628,410 B2 1/2014 Jaffe et al.
9,990,804 B2 * 6/2018 Aoki ..... G07F 17/326
2002/0138594 A1 9/2002 Rowe
2002/0155874 A1 10/2002 Byrne
2003/0003989 A1 1/2003 Johnson
2003/0014370 A1 1/2003 Charrin
2003/0027618 A1 2/2003 Byrne
2003/0027625 A1 2/2003 Rowe
2003/0032475 A1 2/2003 Yoseloff
2003/0036430 A1 2/2003 Cannon
2003/0045337 A1 3/2003 Byrne
2003/0045351 A1 3/2003 Gauselmann
2003/0050106 A1 3/2003 Lyfoung
2003/0060266 A1 3/2003 Baerlocher
2003/0064776 A1 4/2003 Byrne
2003/0069056 A1 4/2003 Cormack et al.
2003/0148807 A1 8/2003 Acres
2003/0148808 A1 8/2003 Price
2003/0181231 A1 9/2003 Vancura et al.
2003/0186733 A1 10/2003 Wolf et al.
2003/0207705 A1 11/2003 Falciglia, Sr.
2003/0211884 A1 11/2003 Gauselmann
2003/0216166 A1 11/2003 Baerlocher et al.
2003/0222402 A1 12/2003 Olive
2003/0228899 A1 12/2003 Evans
2003/0236116 A1 12/2003 Marks et al.
2004/0009808 A1 1/2004 Gauselmann
2004/0009811 A1 1/2004 Torango
2004/0023716 A1 2/2004 Gauselmann
2004/0038741 A1 2/2004 Gauselmann
2004/0048644 A1 3/2004 Gerrard et al.
2004/0053673 A1 3/2004 Mishra
2004/0092304 A1 5/2004 George et al.
2004/0092315 A1 5/2004 Boyd et al.
2004/0152511 A1 8/2004 Nicely et al.
2005/0003880 A1 1/2005 Englman et al.
2005/0055113 A1 3/2005 Gauselmann
2005/0059467 A1 3/2005 Saffari et al.
2005/0059472 A1 3/2005 Joshi et al.
2005/0059481 A1 3/2005 Joshi et al.
2005/0064930 A1 3/2005 Jubinville et al.
2005/0096130 A1 5/2005 Mullins
2005/0137010 A1 6/2005 Enzminger et al.
2005/0192088 A1 9/2005 Hartman et al.
2005/0215313 A1 9/2005 O'Halloran
2005/0239542 A1 * 10/2005 Olsen ..... G07F 17/32 463/27
2006/0003829 A1 1/2006 Thomas
2006/0019737 A1 1/2006 Yang
2006/0025195 A1 2/2006 Pennington et al.
2006/0025210 A1 2/2006 Johnson
2006/0030403 A1 2/2006 Lafky et al.
2006/0035706 A1 2/2006 Thomas et al.
2006/0052159 A1 3/2006 Cahill et al.
2006/0052160 A1 3/2006 Saffari et al.
2006/0073887 A1 4/2006 Nguyen et al.
2006/0073889 A1 4/2006 Edidin et al.
2006/0116201 A1 6/2006 Gauselmann
2006/0135254 A1 6/2006 Thomas
2006/0142086 A1 6/2006 Blackburn et al.
2006/0154718 A1 7/2006 Willyard et al.
2006/0183535 A1 8/2006 Marks et al.
2006/0183537 A1 8/2006 Dickerson
2006/0183538 A1 8/2006 Michaelson et al.
2006/0189380 A1 8/2006 Schultz et al.
2006/0281527 A1 12/2006 Dunaevsky et al.
2006/0287077 A1 12/2006 Grav et al.
2007/0026941 A1 2/2007 Block et al.
2007/0054733 A1 3/2007 Baerlocher
2007/0060244 A1 3/2007 Yaldoo et al.

(56) References Cited

U.S. PATENT DOCUMENTS

| | | | | |
|---|---|---|---|---|
| 2007/0060271 | A1 | 3/2007 | Cregan et al. | |
| 2007/0060314 | A1 | 3/2007 | Baerlocher et al. | |
| 2007/0060319 | A1 | 3/2007 | Block et al. | |
| 2007/0060365 | A1 | 3/2007 | Tien et al. | |
| 2008/0090653 | A1 | 4/2008 | Kuehling et al. | |
| 2008/0153587 | A1 | 6/2008 | Yoshimura | |
| 2008/0254869 | A1 | 10/2008 | Fujimoto et al. | |
| 2009/0104986 | A1 | 4/2009 | Englman et al. | |
| 2009/0124363 | A1 | 5/2009 | Baerlocher et al. | |
| 2009/0131149 | A1 | 5/2009 | Jackson et al. | |
| 2009/0143127 | A1 | 6/2009 | Frick et al. | |
| 2009/0247302 | A1 | 10/2009 | Kelly et al. | |
| 2009/0264191 | A1 | 10/2009 | Roukis et al. | |
| 2009/0270168 | A1* | 10/2009 | Englman ..... | G07F 17/32 463/27 |
| 2009/0291732 | A1 | 11/2009 | Lutnick et al. | |
| 2009/0298574 | A1 | 12/2009 | Gauselmann | |
| 2009/0298595 | A1 | 12/2009 | Okuaki | |
| 2009/0305776 | A1 | 12/2009 | Englman et al. | |
| 2009/0305777 | A1 | 12/2009 | Anderson | |
| 2010/0016062 | A1 | 1/2010 | Baerlocher | |
| 2010/0041459 | A1 | 2/2010 | Saffari et al. | |
| 2010/0062841 | A1 | 3/2010 | Englman et al. | |
| 2010/0087245 | A1 | 4/2010 | Johnson | |
| 2010/0087246 | A1 | 4/2010 | Ward | |
| 2010/0093420 | A1 | 4/2010 | Wright et al. | |
| 2010/0124989 | A1 | 5/2010 | Englman et al. | |
| 2010/0197386 | A1 | 8/2010 | Lafky et al. | |
| 2010/0222137 | A1 | 9/2010 | Goto et al. | |
| 2010/0261521 | A1 | 10/2010 | Oatman et al. | |
| 2010/0304830 | A1 | 12/2010 | Englman et al. | |
| 2010/0331071 | A1 | 12/2010 | Uchiyama et al. | |

FOREIGN PATENT DOCUMENTS

| | | | |
|---|---|---|---|
| DE | 19624321 | A1 | 1/1998 |
| DE | 19515983 | C2 | 4/2003 |
| EP | 521599 | A1 | 1/1993 |
| GB | 2153572 | A | 8/1985 |
| GB | 2181589 | A | 4/1987 |
| GB | 2242300 | A | 9/1991 |
| GB | 2313792 | A | 12/1997 |
| GB | 2333880 | A | 8/1999 |
| WO | 9903078 | A1 | 1/1999 |
| WO | 9919037 | A1 | 4/1999 |
| WO | 03026754 | A1 | 4/2003 |
| WO | 03083789 | A1 | 10/2003 |
| WO | 2007094250 | A1 | 8/2007 |
| WO | 2008060429 | A2 | 5/2008 |
| WO | 2008060442 | A2 | 5/2008 |
| WO | 2008060442 | A3 | 7/2008 |
| WO | 2008060442 | A9 | 8/2008 |
| WO | 2008060429 | A3 | 10/2008 |

OTHER PUBLICATIONS

Product Sheet for "Big Games Safari," IGT, 24 pages (2000).
Article for "Easy Riches" by Sigma Game, Strictly Slots, 1 page (Aug. 2001).
Article for "Millioniser" by Glenn Haussman, Strictly Slots, pp. 50-53 (Mar. 2004).

* cited by examiner

WAGERING GAME HAVING INTERLINKED PROGRESSIVE VALUES WITH SHARED INCREMENT

CROSS-REFERENCE TO RELATED APPLICATIONS

This application claims the benefit of U.S. patent application Ser. No. 14/494,846, filed on 24 Sep. 2014, which is hereby incorporated by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, Bally Gaming, Inc.

FIELD OF THE INVENTION

The present invention relates generally to gaming systems, apparatus, and methods and, more particularly, to progressive wagering games.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been employed to enhance player entertainment and achieve player loyalty is the use of progressive games. In the gaming industry, a "progressive" game historically involves collecting coin-in data from participating gaming device(s) (e.g., slot machines), contributing a percentage of that coin-in data to a progressive jackpot, and awarding that jackpot amount to a player upon the occurrence of a certain jackpot-triggering event. A jackpot-triggering event may occur when a "progressive winning position" is achieved at a participating gaming device. If the gaming device is a slot machine, a progressive winning position may correspond to alignment of progressive-jackpot symbols along a certain payline. The initial progressive jackpot is a predetermined minimum amount. The jackpot amount, however, progressively increments to higher values as players continue to play the gaming machine without winning the jackpot. Further, when several gaming machines are linked together such that several players at several gaming machines compete for the same jackpot, the jackpot increments at a much faster rate, which leads to further player excitement. Typically, once the progressive jackpot is awarded, the jackpot amount is reset to the predetermined minimum amount, which is often referred to as the "reset value."

In existing progressive games, there may be a single progressive jackpot or multiple progressive jackpots that may be awarded and incremented. Each progressive jackpot is typically awarded upon the occurrence of a single, qualifying jackpot-won event (e.g., a predetermined symbol combination on an active payline of the base game). While some progressive game features provide some enhanced excitement, there is a continuing need to develop new features for progressive games to satisfy the demands of players and operators. Such new features for progressive games will further enhance player excitement, perpetuate player loyalty, and thus increase game play. The present invention helps to satisfy this market demand.

SUMMARY OF THE INVENTION

According to one aspect of the present invention, a gaming system is primarily dedicated to playing a regulated casino wagering game providing eligibility to a plurality of progressive jackpots. The gaming system comprises a secure gaming cabinet, an electronic display device, an electronic input device, a random element generator, and game-logic circuitry. The secure gaming cabinet houses components associated with the casino wagering game. The electronic display device is coupled to the gaming cabinet. The electronic input device is coupled to the gaming cabinet. The electronic input device is configured to receive a physical input from a player indicative of a wager to initiate the casino wagering game and to transform the input into an electronic data signal. The random element generator configured to generate one or more random elements. The game-logic circuitry is configured to (i) initiate the casino wagering game in response to the electronic data signal from the electronic input device, (ii) determine an outcome of the casino wagering game based, at least in part, on the one or more random elements, (iii) direct the electronic display device to display values associated with the plurality of progressive jackpots, (iv) allocate a portion of the wager to at least one of a plurality of primary progressive jackpot within the plurality of progressive jackpots, (v) direct the electronic display device to increment the values of the at least one primary progressive jackpot based on the allocated portion of the wager, (vi) direct the electronic display device to increment the values of a plurality of secondary progressive jackpots within the plurality of progressive jackpots based on the values of the primary progressive jackpots such that incrementing one of the primary progressive jackpots causes incrementing of at least one secondary progressive jackpot, (vii) award a tangible award in response to the outcome being a progressive-triggering outcome such that the progressive-triggering outcome results in one of the secondary progressive jackpots being awarded to the player, and (viii) in response to the outcome being the progressive-triggering outcome, direct the electronic display device to display a reset value for the awarded one of the secondary progressive jackpots and a reset value for at least one primary progressive jackpot upon which the value of the awarded one of the secondary progressive jackpots was based. The invention also relates to methods of operating the gaming system.

According to another aspect of the present invention, a gaming system is primarily dedicated to playing a regulated casino wagering game providing eligibility to a plurality of progressive jackpots. The gaming system comprises a secure gaming cabinet, an electronic display device, an electronic input device, a random element generator, and game-logic circuitry. The secure gaming cabinet houses components associated with the casino wagering game. The electronic display device is coupled to the gaming cabinet. The electronic input device is coupled to the gaming cabinet. The electronic input device is configured to receive a physical input from a player indicative of a wager to initiate the casino wagering game and to transform the input into an electronic data signal. The random element generator configured to generate one or more random elements. The game-logic circuitry is configured to (i) initiate the casino wagering game in response to the electronic data signal from the electronic input device, (ii) determine an outcome of the casino wagering game based, at least in part, on the one or more random elements, (iii) direct the electronic display device to display values associated with the plurality of progressive jackpots, (iv) allocate a portion of the wager to at least one of a plurality of first progressive jackpot within the plurality of progressive jackpots, (v) direct the electronic display device to increment the values of the at least one of the plurality of first progressive jackpots based on the allocated portion of the wager, (vi) direct the electronic display device to increment the values of a plurality of second progressive jackpots within the plurality of progressive jackpots based on the values of the first progressive jackpots, (vii) award a tangible award in response to the outcome being a progressive-triggering outcome such that the progressive-triggering outcome results in one of the plurality of progressive jackpots being awarded to the player, and (viii) in response to the outcome being the progressive-triggering outcome, direct the electronic display device to display a reset value for the awarded progressive jackpot and an altered reduced value for another one of the plurality of progressive jackpots. The invention further relates to methods of operating the gaming system.

In another aspect, the invention relates to a casino gaming machine primarily dedicated to playing a regulated casino wagering game that provides eligibility to a plurality of progressive jackpots. The casino gaming machine comprises a secure gaming cabinet, an electronic display device, an electronic input device, and game-logic circuitry. The secure gaming cabinet is for housing components associated with the casino wagering game. The electronic display device is coupled to the gaming cabinet. The electronic input device is coupled to the gaming cabinet. The electronic input device is configured to receive a physical input indicative of a wager from a player to initiate the casino wagering game and transform the input into an electronic data signal. The game-logic circuitry is disposed within the gaming cabinet and includes a random element generator. The random element generator is configured to generate one or more random elements. The game-logic circuitry is configured to (i) initiate the casino wagering game in response to the electronic data signal from the electronic input device, (ii) determine an outcome of the casino wagering game based, at least in part, on the one or more random elements, (iii) allocate a portion of the wager to a first progressive jackpot associated with a first group of progressive jackpots within the plurality of progressive games, (iv) direct the electronic display device to display values associated with the first group of progressive jackpots, (v) direct the electronic display device to increment the values of the first progressive jackpot based on the allocated portion of the wager, (vi) based on the values of the first progressive jackpot, direct the electronic display device to increment the values of other members of the first group of progressive jackpots, (vii) award a tangible award in response to the outcome being a progressive-triggering outcome such that the progressive-triggering outcome results in one of the first group of progressive jackpots being awarded to the player, and (viii) in response to the outcome being the progressive-triggering outcome, direct the electronic display device to display a reset value for each of the first group of progressive jackpots. The invention also relates to methods of operating the casino gaming machine.

Additional aspects of the invention will be apparent to those of ordinary skill in the art in view of the detailed description of various embodiments, which is made with reference to the drawings, a brief description of which is provided below.

Figure 1:
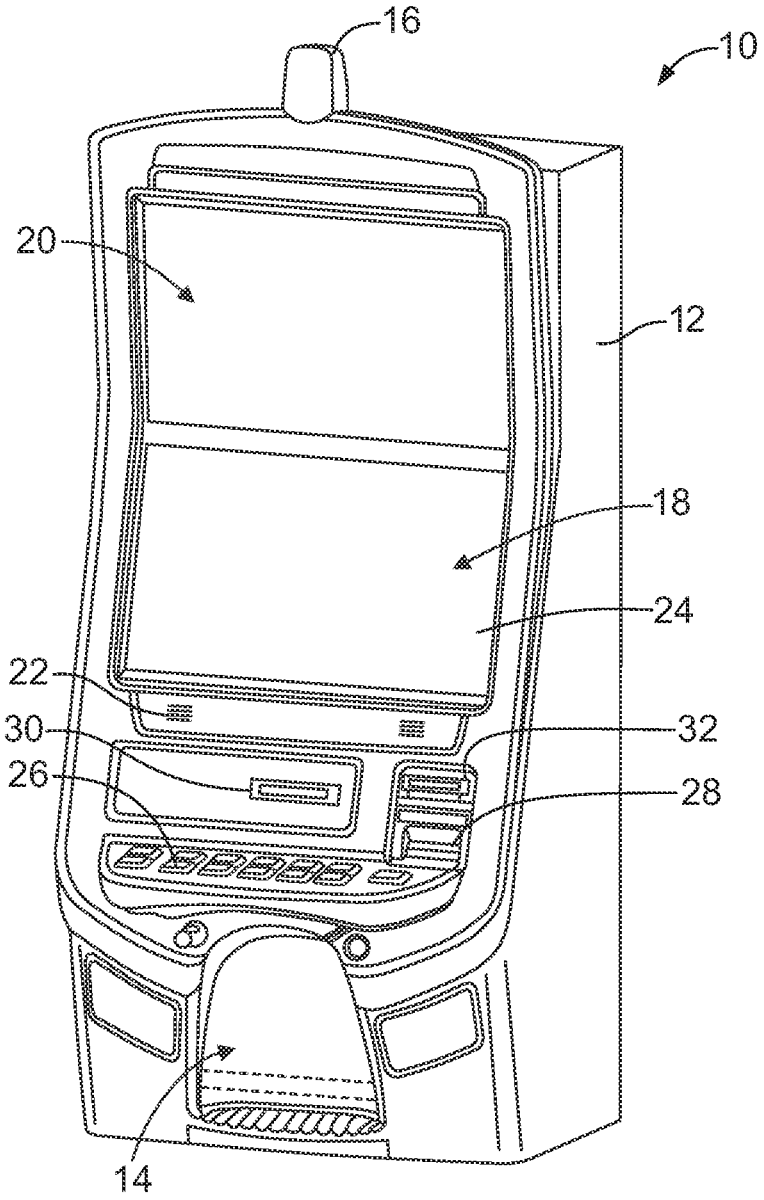
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
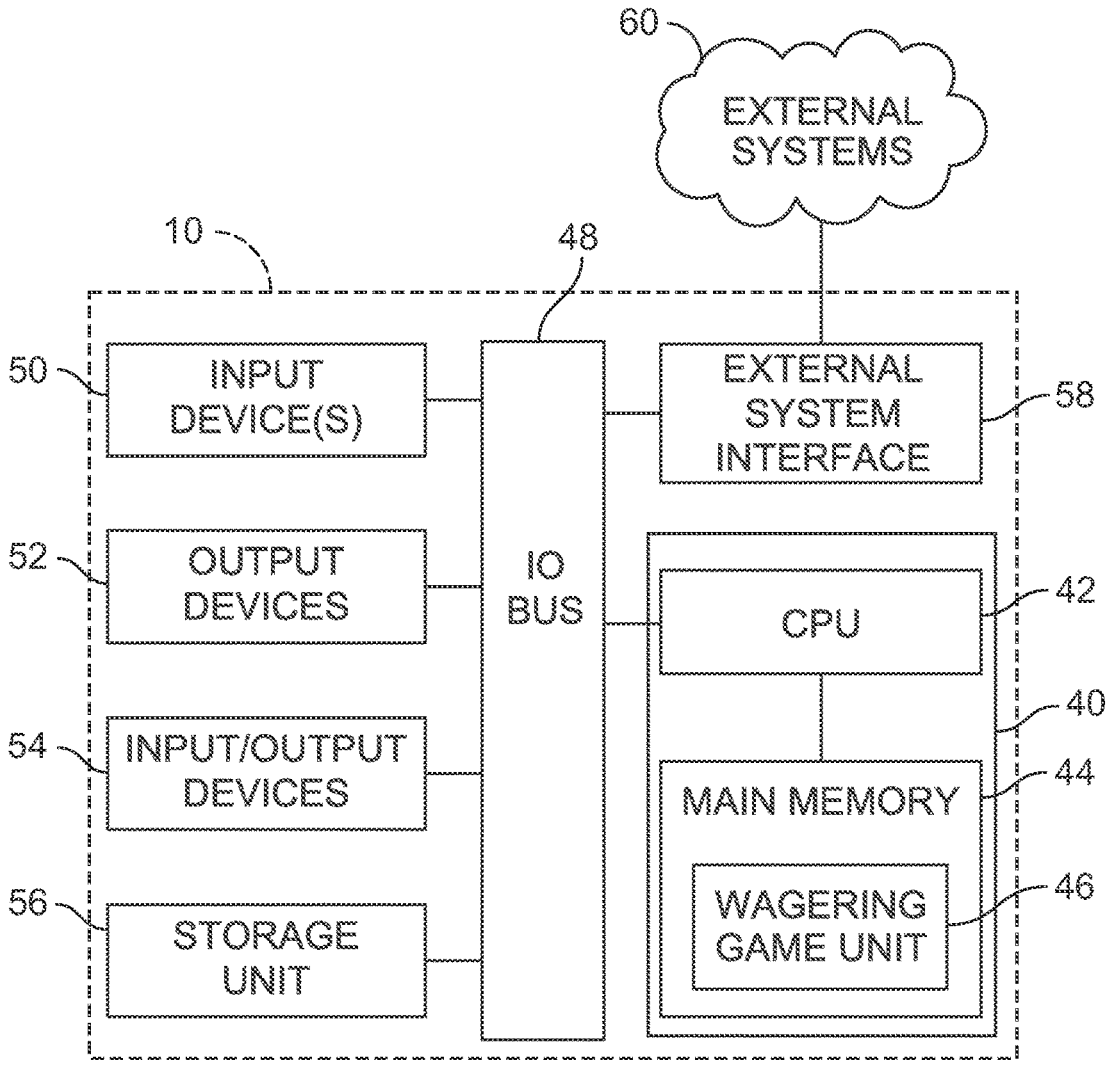
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
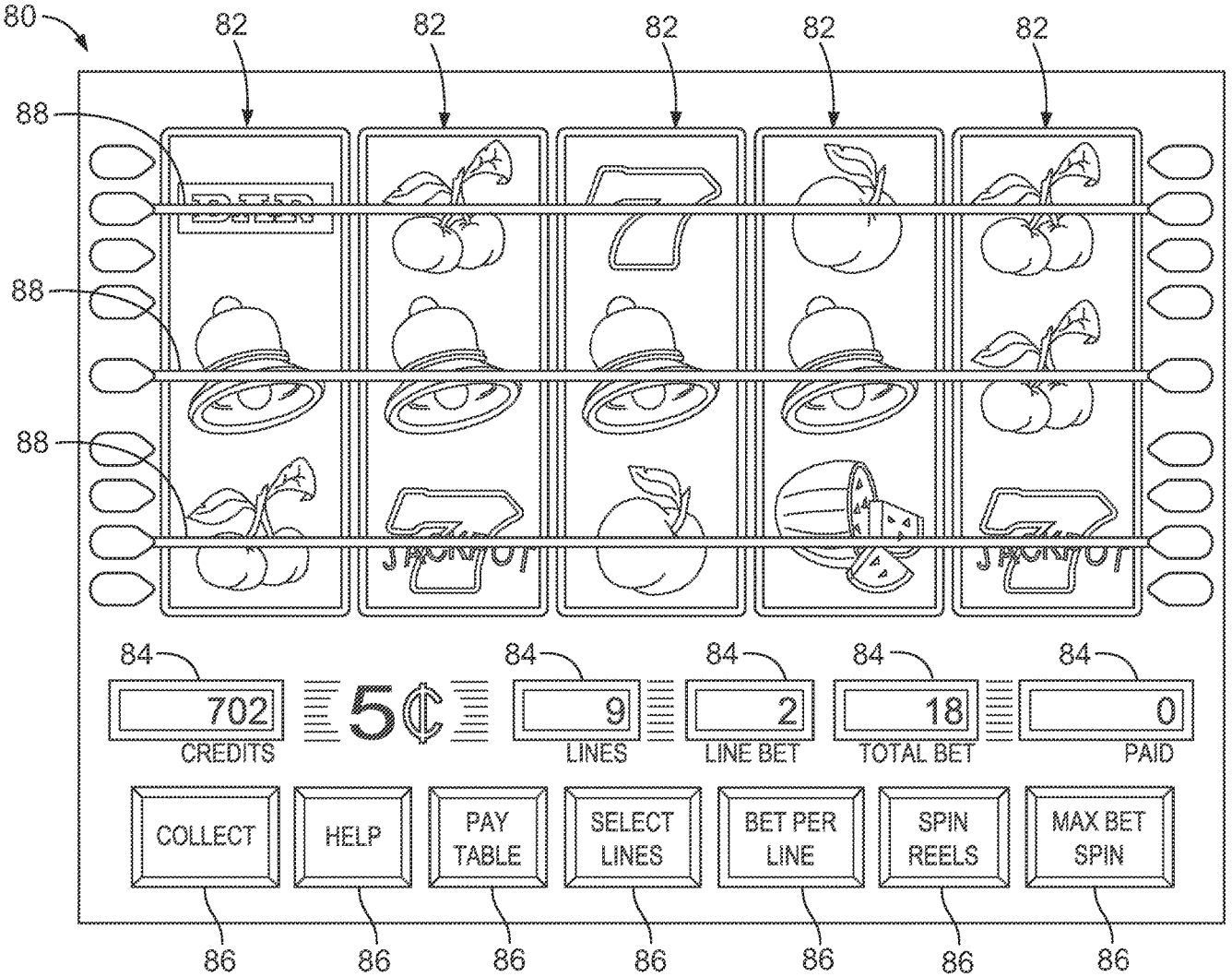
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for security and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions.

Figure 4:
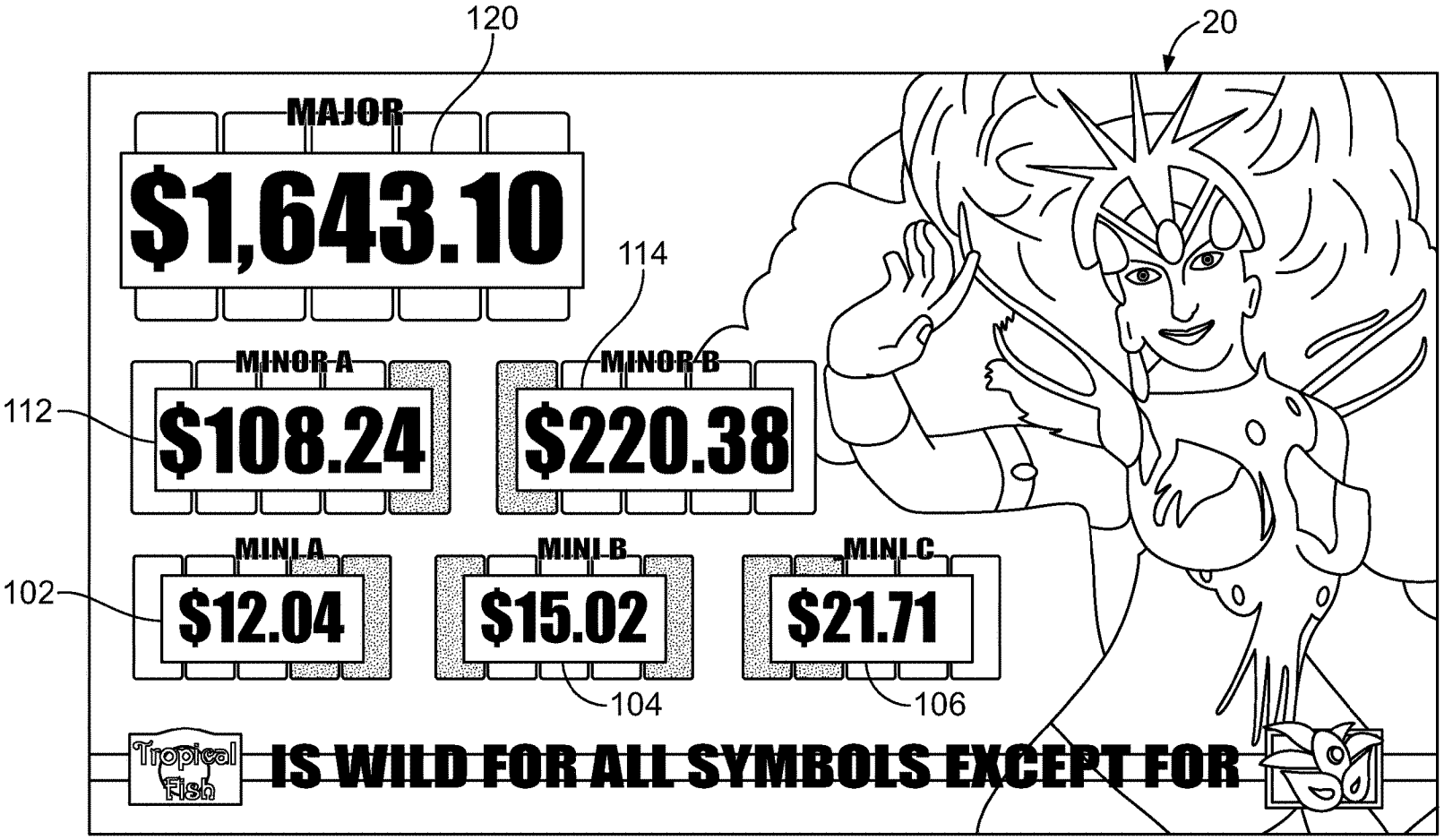
FIG. 4 is an image of an exemplary progressive game displayed on the gaming machine, according to an embodiment of the present invention.

Referring now to FIG. 4, the secondary display 20 of the gaming machine 10 is displaying six progressive jackpots to which the player of the primary game is eligible. The lowest three progressive jackpots are the Mini A jackpot 102, Mini B jackpot 104, and Mini C jackpot 106. The middle two progressive jackpots are the Minor A jackpot 112 and the Minor B jackpot 114. The highest progressive jackpot is the Major jackpot 120. As will be described in more detail with reference to FIG. 6, the values of these six progressive jackpots are different, but related to each other. The values of these six progressives jackpots will increase (i.e., increment) as wager inputs are received from players who initiate the primary wagering game, which can be, for example, the slot game having the plurality of reels 82 described above with reference to FIG. 3. Upon initiating the primary wagering game with the wager input via the value input device (e.g., the bill/ticket acceptor 28 or the card reader/writer 30 in FIG. 1) on the gaming machine 10, a player is eligible to win one or more of these six progressive jackpots.

Figure 5:
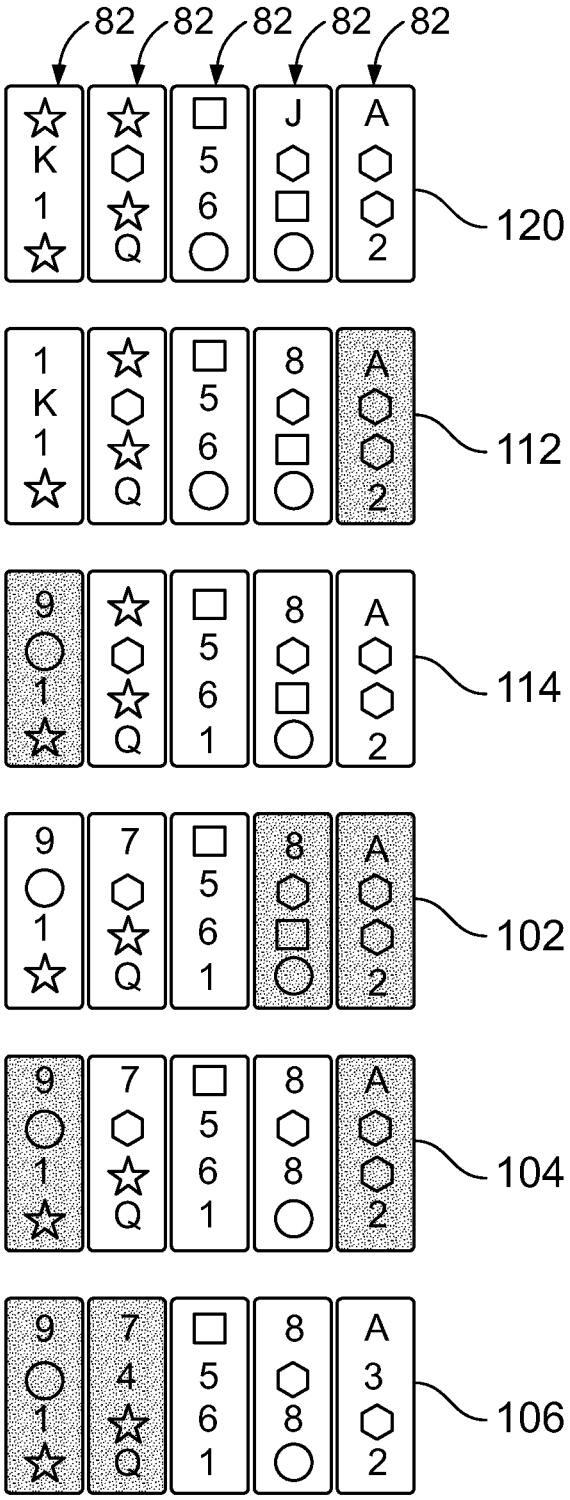
FIG. 5 is a schematic illustration of the triggering events for the six progressive jackpots in FIG. 4.

FIG. 5 schematically illustrates the trigger-indication mechanism for each one of the six progressive jackpots shown in FIG. 4. Each of the symbol-bearing reels 82 on the primary display 12 of the gaming machine 10 has a background color (or other identifiable indicia) to indicate a certain state of that reel 82. As shown in the example of FIG. 5, the background color is either a light color or a dark color. In this embodiment, the light color of the background on the reels 82 is advantageous to the player because it can cause the triggering of the progressive jackpots. In particular, if each of the reels 82 has the light color for the background, then the Major jackpot 120 is awarded to the player. If the first four reels 82 have the light color for the background, then the player is awarded the Minor A jackpot 112. If the last four reels 82 have the light color for the background, then the player is awarded the Minor B jackpot 114. If the first three reels 82 have the light color for the background, then the player is awarded the Mini A jackpot 102. If the middle three reels 82 (i.e., the second, third, and fourth reels 82) have the light color for the background, then the player is awarded the Mini B jackpot 104. If the last three reels 82 have the light color for the background, then the player is awarded the Mini C jackpot 106. This trigger-indication coloring scheme for the background of the reels 82 is also displayed to the player in an underlying fashion behind the six award values of the six progressives on the secondary display 20 in FIG. 4.

Of course, there are many other ways to indicate to the player that he or she has triggered a progressive jackpot in accordance with the present invention, such as a symbol-driven award whereby certain symbols displayed on the reels 82 indicate a progressive jackpot award. Alternatively, the progressive jackpot can be "mystery" triggered, which is where the cause or timing of the trigger is invisible to the player. One example of a mystery-triggered progressive is when a randomly selected threshold value (which is unknown to the players) for one or more the progressive jackpots is achieved through the incrementing process upon receipt of wager inputs. In this alternative, the player whose wager input causes one or more the progressive jackpots to move past the threshold value is awarded the associated progressive jackpot(s).

Figure 6:
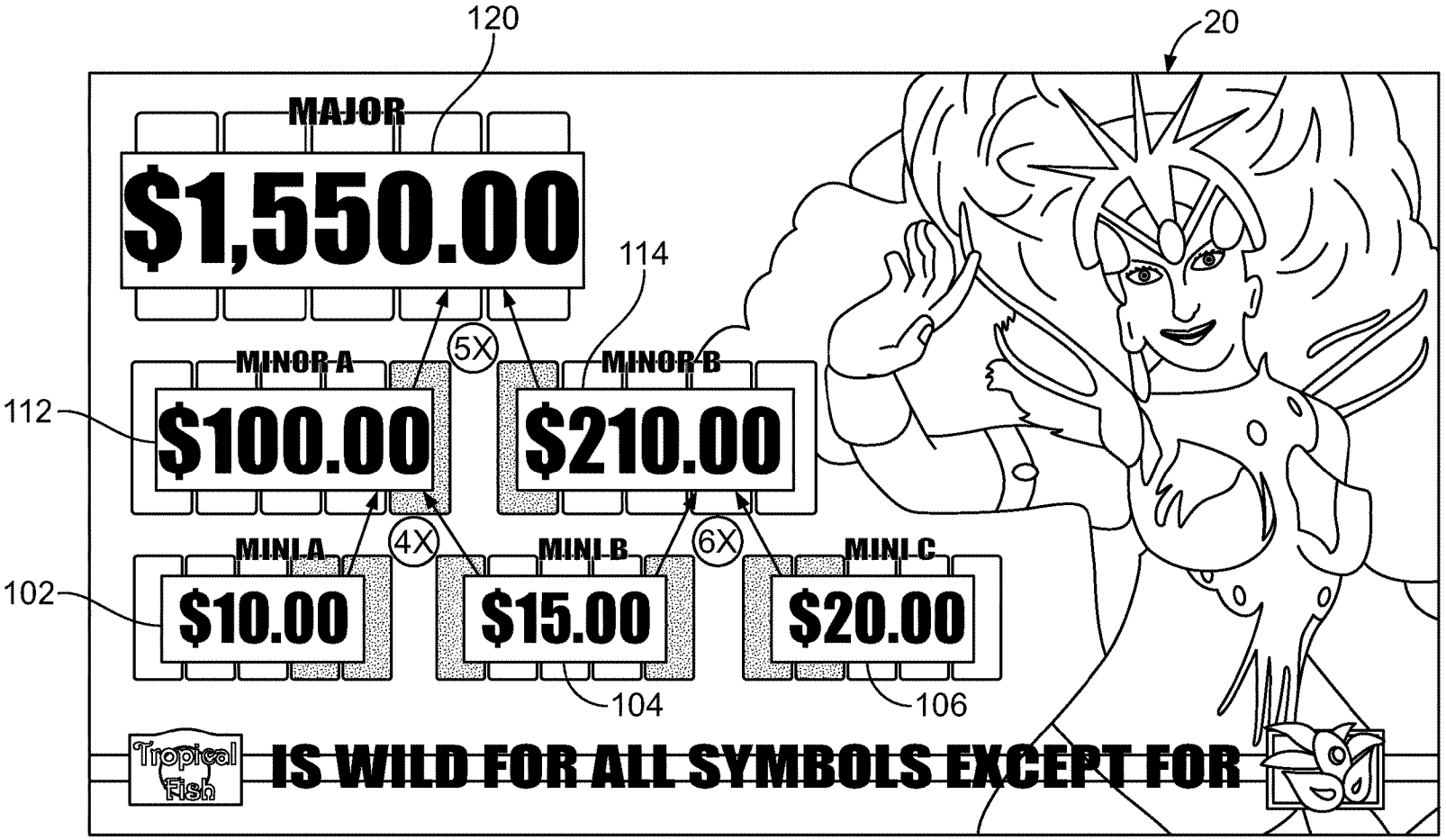
FIG. 6 is a schematic illustration of the relationships between the values of the six progressive jackpots in FIG. 4.

FIG. 6 schematically illustrates the relationship between the six progressive jackpots set forth in FIG. 4. For simplicity, each of the six jackpots is illustrated at an exemplary base reset value, which would occur when the gaming machine 10 is initiated into a game play mode or after a player has achieved the Major award 120 and all progressive jackpots have been reset. The Mini A jackpot 102, the Mini B jackpot 104, and the Mini C jackpot 106 have reset values of $10, $15 and $20, respectively. When players begin to play the primary wagering game (e.g., slots game) on the gaming machine 10, a portion of each wager input is allocated to the Mini A jackpot 102, the Mini B jackpot 104, and the Mini C jackpot 106. The allocation to the Mini A jackpot 102, the Mini B jackpot 104, and the Mini C jackpot 106 can be equal, but is usually unequal such that the Mini A jackpot 102, the Mini B jackpot 104, and the Mini C jackpot 106 receive a different percentage of each wager input (e.g., 1%, 2%, and 5%) and, thus, increment at different rates.

As shown by the arrows and multipliers in FIG. 6, the values of the Minor A jackpot 112 and the Minor B jackpot 114 are based on the values of the Mini A jackpot 102, the Mini B jackpot 104, and the Mini C jackpot 106. In particular, the value of the Minor A jackpot 112 is equivalent to the summation of the Mini A jackpot 102 and the Mini B jackpot 104 multiplied by four. The value of the Minor B jackpot 114 is equivalent to the summation of the Mini B jackpot 102 and the Mini C jackpot 104 multiplied by six. Furthermore, the value of the Major jackpot 120 is equivalent to the summation of the Minor A jackpot 112 and the Minor B jackpot 114 multiplied by five. In other words, the three values of the Minor A jackpot 112, the Minor B jackpot 114, and the Major jackpot 120 are based on the values of the Mini A jackpot 102, the Mini B jackpot 104, and the Mini C jackpot 106, which are incrementing due to wager inputs from the players. And because of the multiplier/summation effect that is applied to the Minor A jackpot 112, the Minor B jackpot 114, and the Major jackpot 120, the incrementing of the Minor A jackpot 112, the Minor B jackpot 114, and the Major jackpot 120 occurs at a higher rate than the incrementing of the Mini A j jackpot 102, the Mini B j jackpot 104, and the Mini C j jackpot 106. It should be understood that the multiplier values of four, five, and six and the base reset values that are shown in the embodiment of FIGS. 4-7 are exemplary only, and many other multiplier values and base reset values can be applied to the six progressive jackpots. As one of skill in the art would appreciate, the selection of the percentages of the wager input allocated to the Mini A jackpot 102, the Mini B jackpot 104, and the Mini C jackpot 106 and the multiplier values (e.g., 4×, 5×, and 6×) have a significant impact on the manner in which the Minor A jackpot 112, the Minor B jackpot 114, and the Major jackpot 120 are incremented, which can lead to an appealing wagering game that enhances player excitement, perpetuates player loyalty, and increases game play.

Figure 7A:
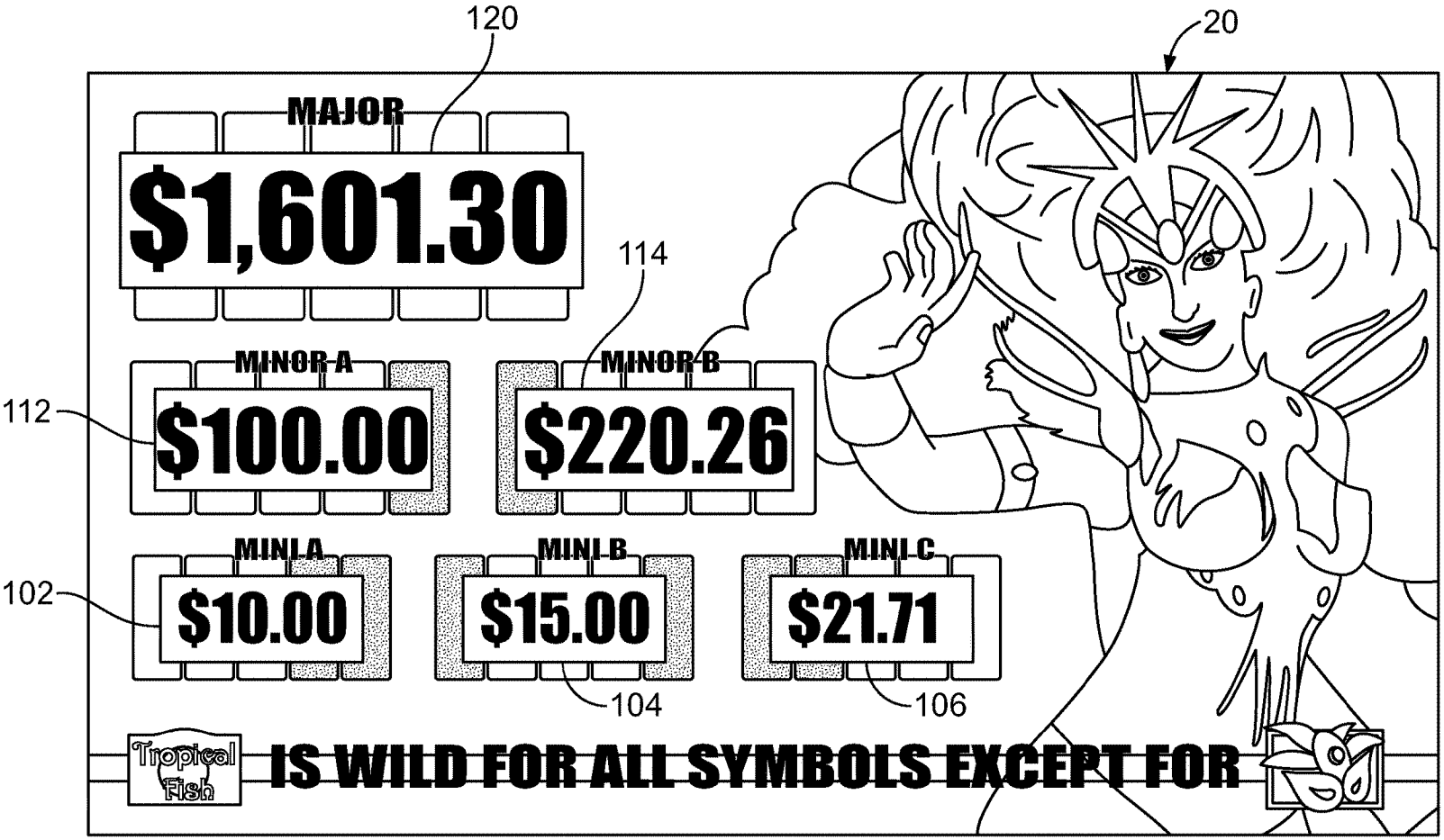
FIG. 7A is an image of the exemplary progressive game displayed on a gaming machine, after one of the progressive awards from FIG. 4 has been triggered.
Figure 7B:
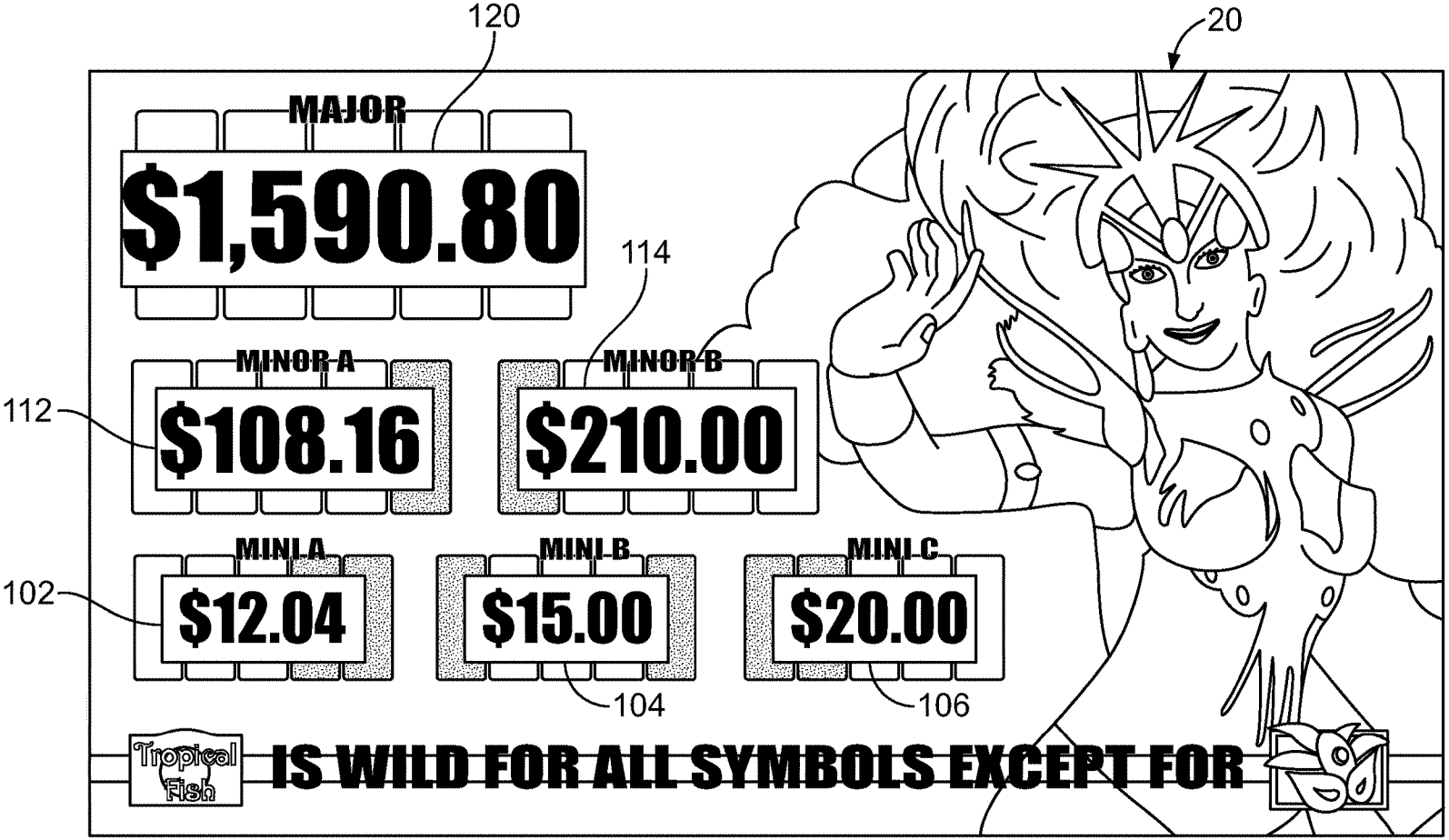
FIG. 7B is an image of the exemplary progressive game displayed on a gaming machine, after a different one of the progressive awards from FIG. 4 has been triggered.
Figure 7C:
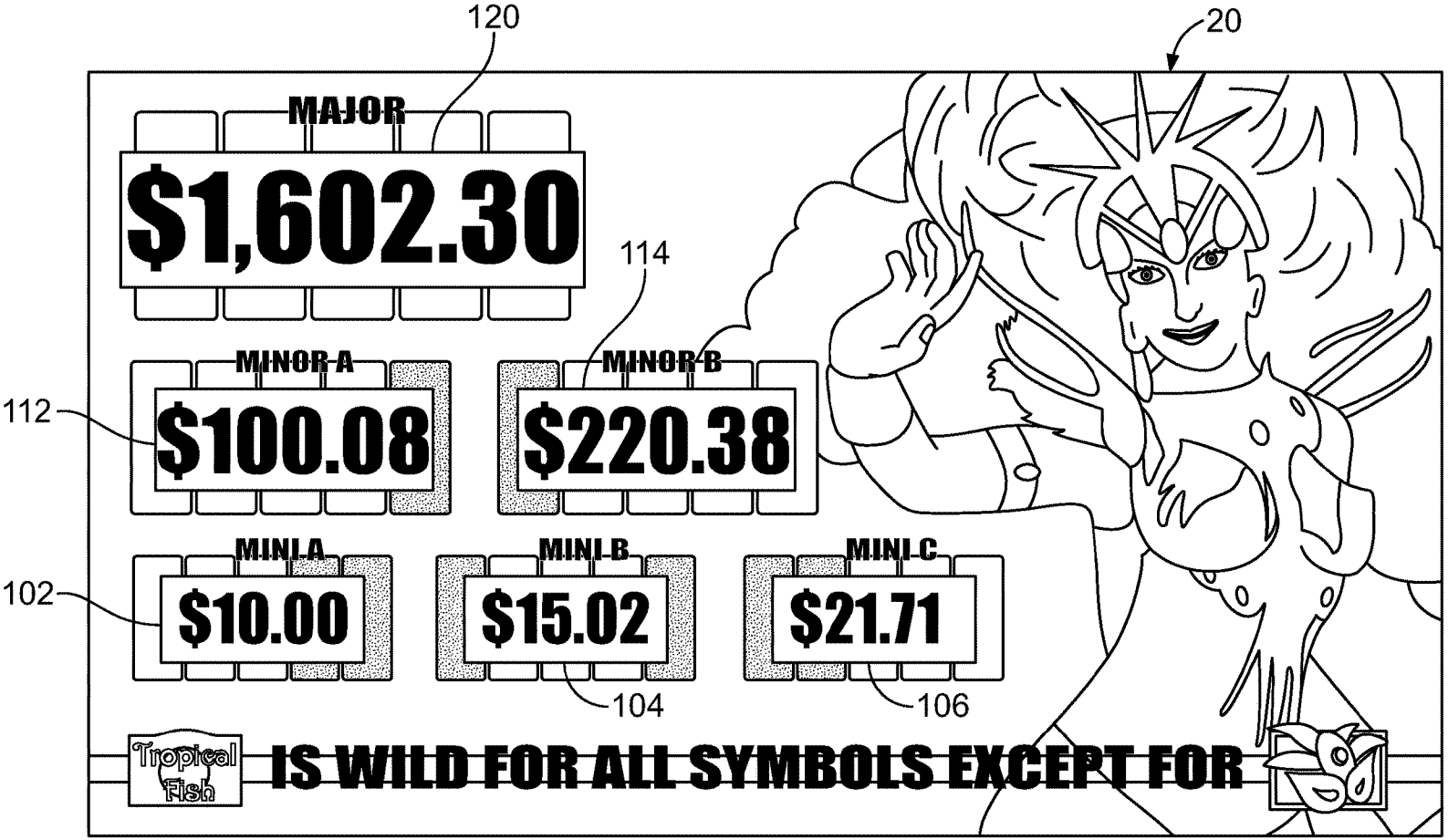
FIG. 7C is an image of the exemplary progressive game displayed on a gaming machine, after yet another one of the progressive awards from FIG. 4 has been triggered.

FIGS. 7A-7C illustrate how the values of one or more of the six progressive jackpots from FIG. 4 are reduced to their base reset value or another lower value after the triggering of one of the six progressive jackpots. In FIG. 7A, the player has triggered the Minor A jackpot 112, which results in the player being awarded $108.24 (FIG. 4). Because the Minor A jackpot 112 is based on the Mini A jackpot 102 and the Mini B jackpot 104, the values of the Mini A jackpot 102 and the Mini B jackpot 104 are reset to their base values of $10 and $15, respectively. And, due to the relationship illustrated in FIG. 6, this also causes the Minor A jackpot 112 to be reset to its own base value of $100 as well. Furthermore, because the Minor B jackpot 114 is partially based on the value of the Mini B jackpot 104, the value of the Minor B jackpot 114 is reduced from $220.38 to $220.26 in accordance with the relationship described in FIG. 6. Finally, because the Major jackpot 120 is based on the values of the Minor A jackpot 112 and the Minor B jackpot 114, the value of the Major jackpot 120 is also reduced from $1643.10 to $1601.30. In other words, the triggering of the Minor A jackpot 112 has an upstream effect on the values of some progressive jackpots and a downstream effect on the values of other progressive jackpots. It is also noteworthy that the Minor B jackpot 114 and the Major jackpot 120 are not reduced to their base reset values ($210.00 and $1550.00, respectively, as show in FIG. 6) because the Mini C jackpot 106 was not impacted by the triggering of the Minor A jackpot 112. Hence, the values of the Minor B jackpot 114 and the Major jackpot 120 are reduced to an amount that is greater than their respective base reset values. After the player has triggered the Minor A jackpot 112, the wager input for the next play (from the same player, the next player at the same gaming machine 10, or possibly another player at a different gaming machine 10 that is linked to the same six progressive jackpots) causes the continued incrementing of the Mini A jackpot 102 and the Mini B jackpot 104 from their base reset values, and the incrementing of the Mini C jackpot 106 from its previous value of $21.71 (FIG. 4).

In FIG. 7B, the player has alternatively triggered the Minor B jackpot 114, which resulted in the player being awarded $220.38 (FIG. 4). Because the Minor B jackpot 114 is based on the Mini B jackpot 104 and the Mini C jackpot 106, the values of the Mini B jackpot 104 and the Mini C jackpot 106 are reset to their base values of $15 and $20, respectively. In a manner similar to the process of FIG. 7A, the Minor B jackpot 114 is reset to its base value of $210. Further, the Minor A jackpot 112 is reduced from $108.24 to $108.16 because it is partially based on the Mini B jackpot 104. And, the Major jackpot 120 is reduced from $1643.10 to $1590.80 because it is partially based on the Minor A jackpot 112 and the Minor B jackpot 114.

In FIG. 7C, the player has triggered the Mini A jackpot 102, which resulted in the player being awarded $12.04 (FIG. 4). The Mini A jackpot 102 is then reset to its base value of $10. Furthermore, the value of the Minor A jackpot 112 is reduced from $108.24 to $100.08 because it is partially based upon the value of the Mini A jackpot 102. Likewise, the value of the Major jackpot 120 is reduced from $1643.10 to $1602.30 because it is based on the value of the Minor A jackpot 112.

In short, in the embodiments of FIGS. 4-7, the incrementing of a first or primary group of progressive jackpots is directly based on allocated portions of the wagers from players, while the incrementing of a secondary group of progressive jackpots is based on the incremented values of the first group of progressive jackpots. Additionally, the awarding of one of the progressive jackpots causes the resetting to the base value of the awarded progressive jackpot, and the reduction in value of other ones of the progressive jackpots. That reduction may be to base reset value, or to a lesser value that is higher than the base reset value.

Figure 8:
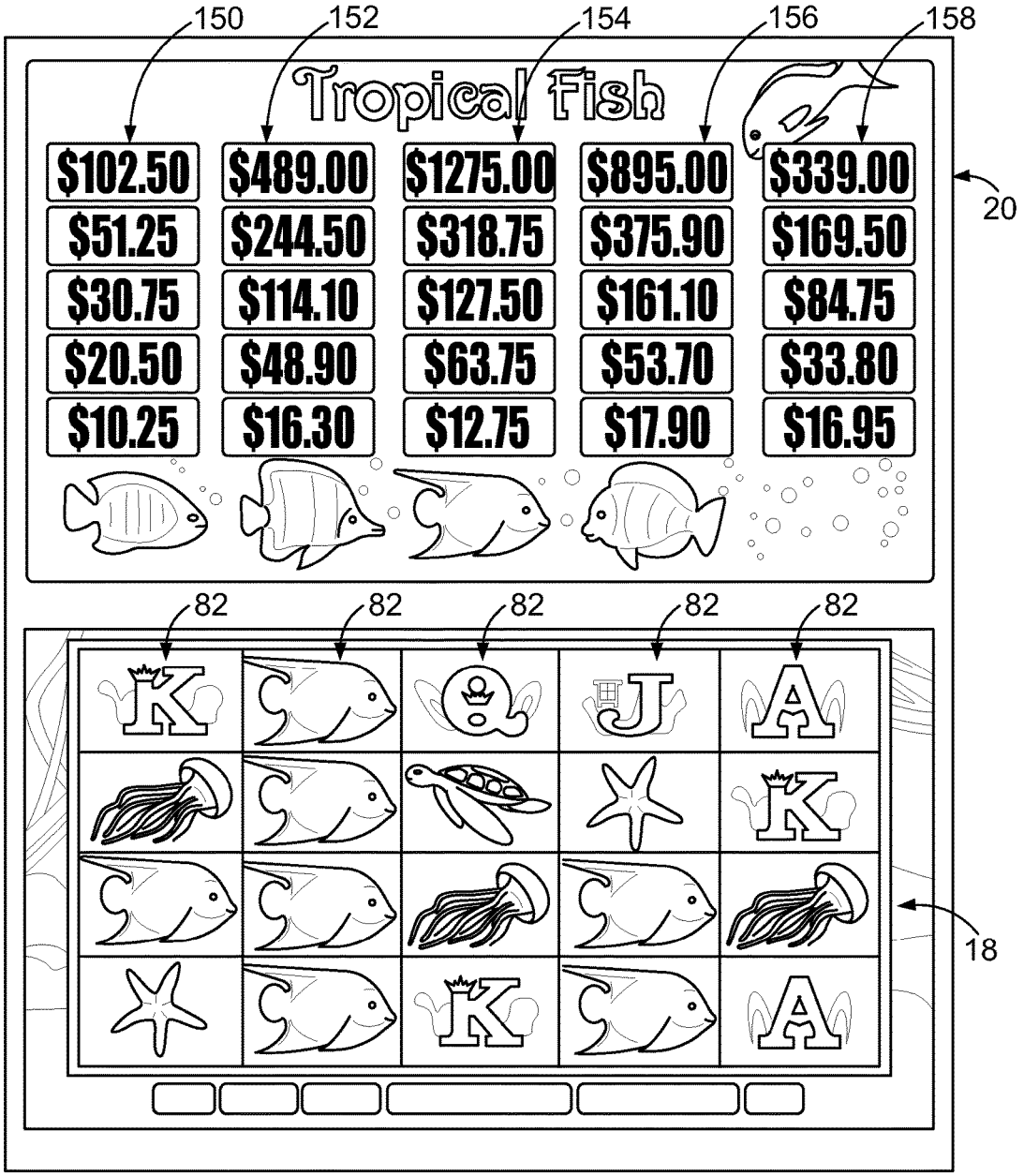
FIG. 8 is an image of an exemplary base game and progressive game displayed on the gaming machine, according to another embodiment of the present invention.
Figure 9:
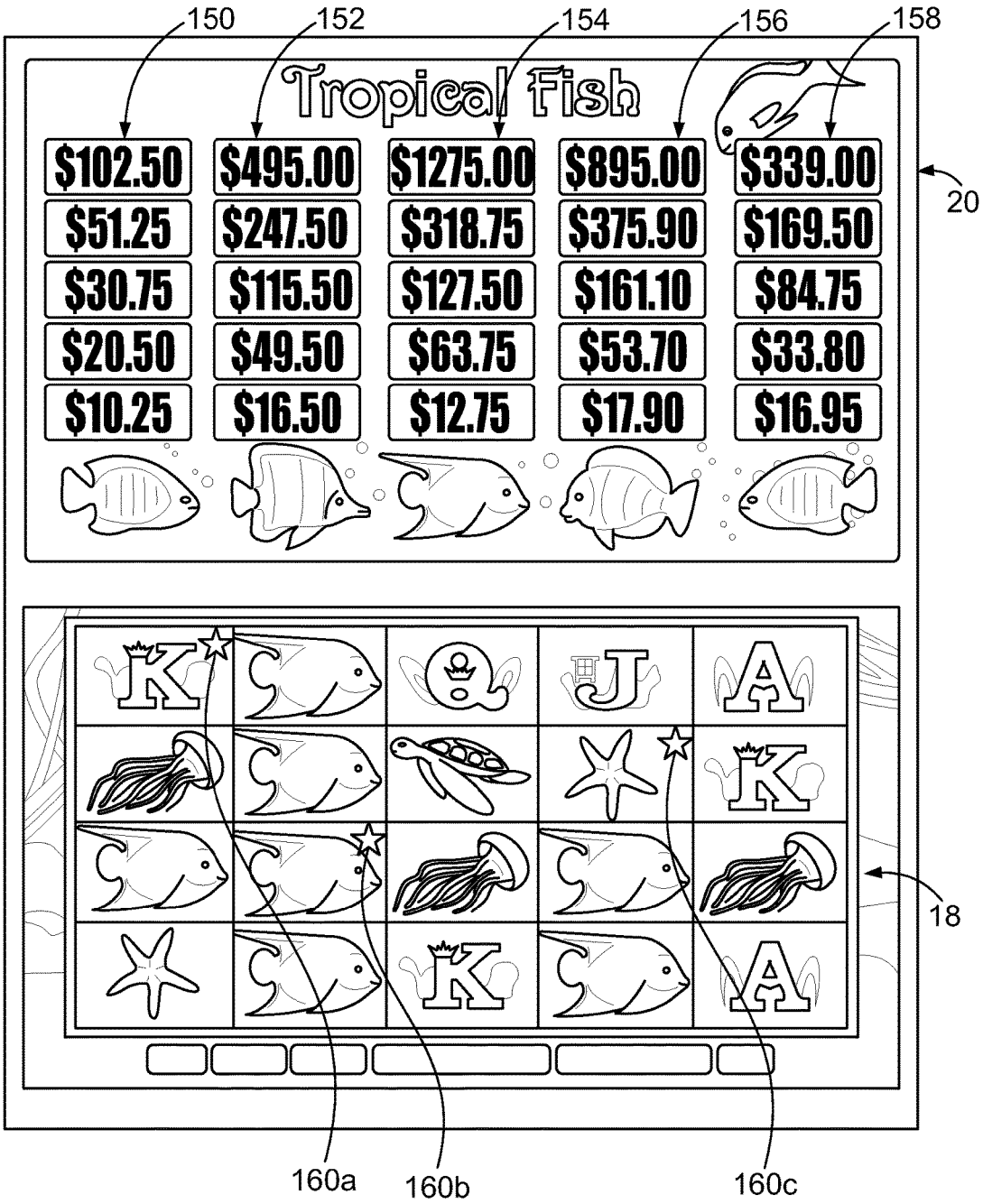
FIG. 9 is an image of the exemplary base game and progressive game of FIG. 8, showing the incrementing values of one group of the progressive jackpots.
Figure 10:
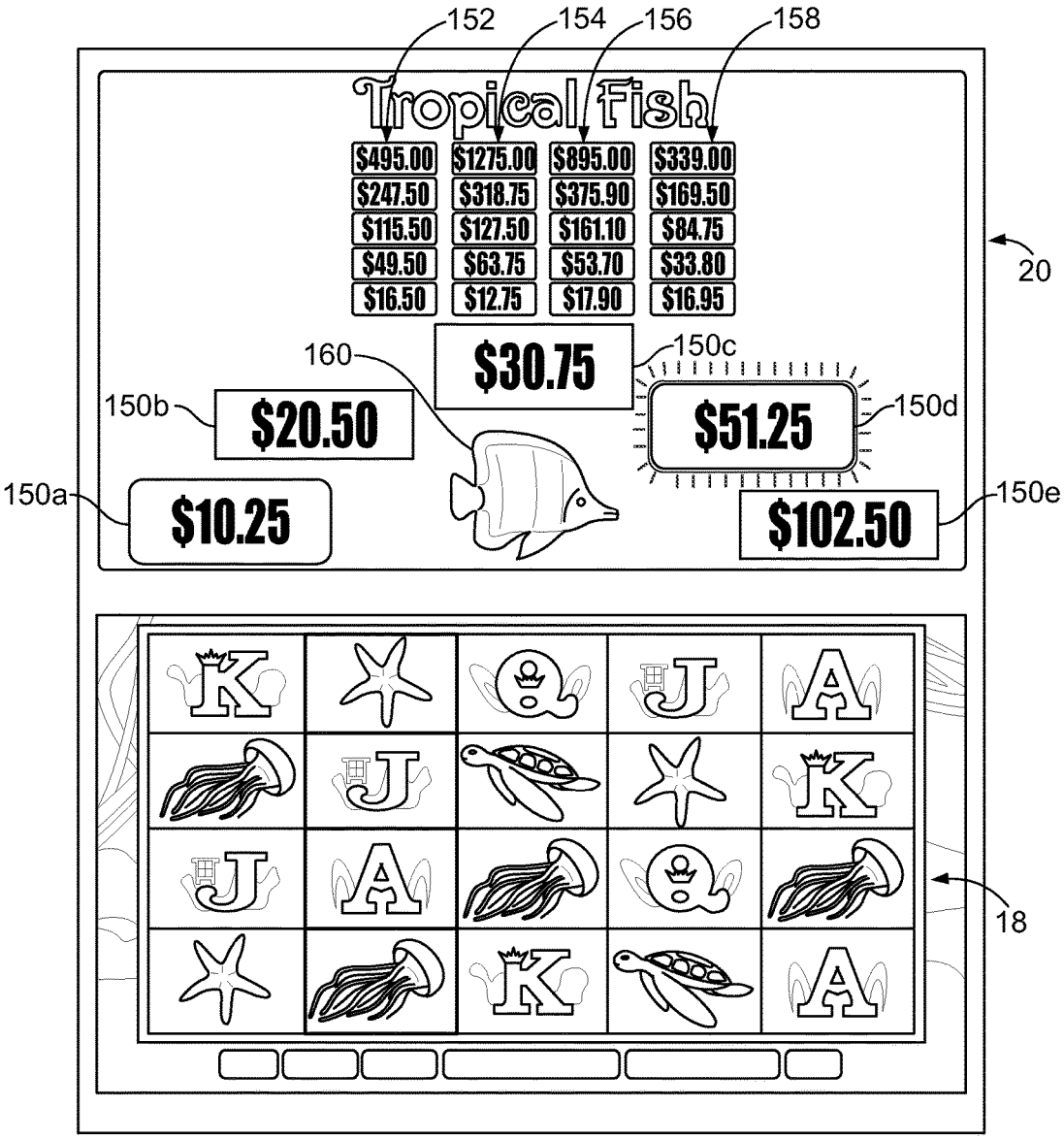
FIG. 10 is an image of the exemplary base game and progressive game of FIG. 8, showing the awarding of one of the progressive jackpots.

FIGS. 8-10 illustrate an alternative embodiment of the present invention. With initial reference to FIG. 8, the primary display 18 is displaying a plurality of symbol-bearing reels 82. The secondary display 20 includes a plurality of progressive jackpots that can be separated into a first group 150, a second group 152, a third group 154, a fourth group 156, and a fifth group 158. In the illustrated embodiment, each of the five groups of progressive jackpots 150-158 includes five different jackpots, such that a player is eligible to win one or more of the twenty-five progressive jackpots.

Within each of the five groups of progressive jackpots 150-158, there is a predetermined relationship among the five jackpots. In this embodiment, a portion of the wager input from the player is allocated to one of the five jackpots, thereby causing that progressive jackpot to increment. The other four jackpots within the same group are then incremented based on the predetermined relationship and the value of the progressive jackpot receiving the allocated portion of the wager. In the illustrated example, the following table provides the relationship between the lowest progressive jackpot (at 1×) and the other four progressive jackpots:

| First Progr. Group 150 | Second Progr. Group 152 | Third Progr. Group 154 | Fourth Progr. Group 156 | Fifth Progr. Group 158 |
|---|---|---|---|---|
| 10X | 30X | 100X | 50X | 20X |
| 5X | 15X | 25X | 21X | 10X |
| 3X | 7X | 10X | 9X | 5X |
| 2X | 3X | 5X | 3X | 2X |
| 1X | 1X | 1X | 1X | 1X |

FIG. 9 illustrates the process by which the progressive jackpots are incremented. As noted in the previous embodiment, there are several ways in which a portion of the wager can be allocated among various progressive jackpots. In FIG. 9, a watermark 160 may appear on various symbols within the primary display 18. In this instance, a STAR watermark 160*a*, 160*b*, 160*c* appears on three symbols, which indicates the amount of the wager to be allocated to the progressive jackpots and also the group of progressive jackpots to which the allocation will occur. Specifically, the STAR watermarks 160*a*, 160*b*, 160*c* are associated with the second progressive jackpot group 152, such that a portion of the wager input is allocated to the second group 152. In particular, $0.20 from the player's wager has been added to the lowest jackpot within the second group 152, causing its value to increase from $16.30 (FIG. 8) to $16.50 (FIG. 9). Accordingly, based on the relationship described above in the table, the other four progressive jackpots within the second group 152 are incremented to new values based on the newly increment value of the lowest jackpot, which is now $16.50. Had more STAR watermarks 160 been present on the symbol array within the primary display 18, a larger percentage (or an additional amount) of the wager input from the player would have been added to the lowest jackpot within the second group 152, resulting in a larger increment of the values of the second group 152. Furthermore, four other types of watermarks are available for the symbol array, each of which causes the incrementing of an associated one of the first group 150, the third group 154, the fourth group 156, and the fifth group 158. In some instances, more than one group of progressive jackpots can be incremented during the same play of the base game on the primary display 18. Of course, there are many other ways (some related to game symbols, and some unrelated to game symbols) to cause the incrementing of the first group 150, the second group 152, the third group 154, the fourth group 156, and the fifth group 158, such as the one described above.

FIG. 10 illustrates one process for awarding the progressive jackpot to the player. In particular, a randomly selected value (which is unknown to the player) is chosen for one progressive jackpot within each of the five groups 150-158. When the actual value of that progressive jackpot exceeds the randomly selected value, that group of progressive jackpots is triggered for the award process. As shown in FIG. 10, the player has triggered the first group of progressive jackpots 150, such that the player may win one of a first progressive jackpot 150*a*, a second progressive jackpot 150*b*, a third progressive jackpot 150*c*, a fourth progressive jackpot 150*d*, and a fifth progressive jackpot 150*e*. An additional random selection then occurs to determine which of the five progressive jackpots 150*a*-150*e* will be awarded to the player. An animated fish 160 swims around the secondary display 20 and indicates the awarded jackpot, which, in this case, is the fourth progressive jackpot 150*d*. In other embodiments, four of the five progressive jackpots 150*a*-150*e* can be sequentially darkened to eliminate that particular jackpot, leaving only the awarded progressive jackpot 150*d* highlighted on the display 20. Of course, there are many other ways to indicate to the player which of the five progressive jackpots 150*a*-150*e* has been awarded. It is also possible to award multiple ones of the progressive jackpots 150*a*-150*e* in some embodiments.

After the fourth progressive jackpot 150*d* has been awarded, the underlying lowest progressive jackpot 150*a* is reset to its base value. Accordingly, each of the four other progressive jackpots 150*b*-150*e* within the first group 150 is reset to its base value in accordance with the table described above. As such, the resetting of one progressive jackpot within the first group 150 causes all of the progressive jackpots within that group to reset.

Because the watermarks 160 dictate the progressive jackpot group to receive a portion of the wager input and multiple types of watermarks may appear in the symbol array, more than one group of progressive jackpots 150-158 can be incremented at the same time. Accordingly, it is possible that the incrementing of each one of multiple progressive jackpot groups 150-158 causes two or more progressive jackpot groups 150-158 to simultaneously exceed its randomly selected value for awarding a progressive jackpot. In that instance, a player may be awarded multiple progressive jackpots during the same play of the underlying wagering game on the primary display 18.

Figure 11:
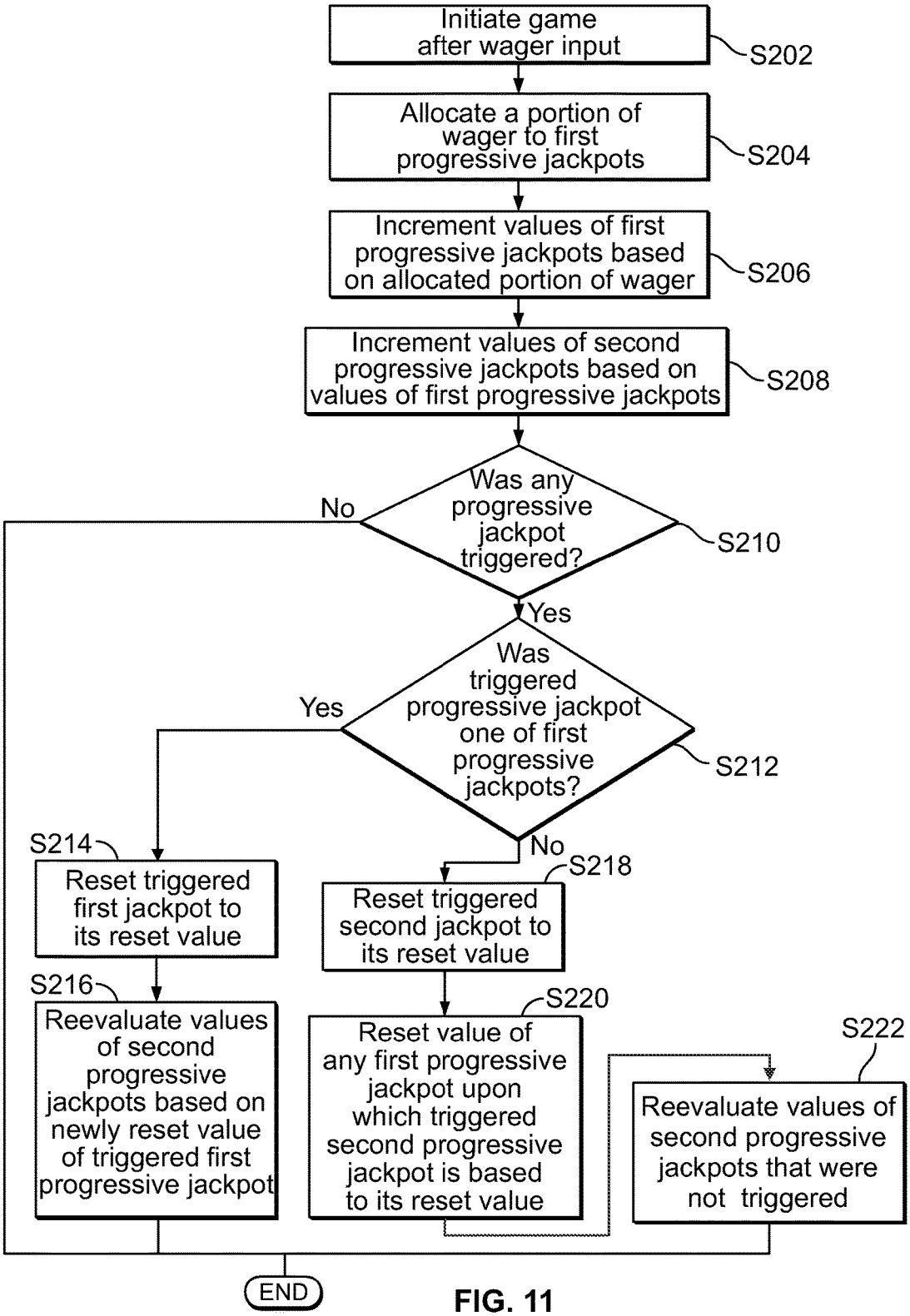
FIG. 11 is a flowchart for an exemplary algorithm that corresponds to instructions executed by a game logic circuitry in accordance with at least some aspects of the disclosed concepts.

FIG. 11, by way of example, represents one algorithm that corresponds to at least some instructions stored and executed by the game-logic circuitry 40 in FIG. 2 to perform the above-described functions associated with the disclosed progressive game. At step S202, a wager is received at the gaming machine 10 from the player to initiate the game. Next, at step S204, a portion of the wager is allocated to one or more of a first set of progressive jackpots. The allocation can occur, for example, after the receipt of a wager, or only after certain symbol indicia appear in the primary game. At step S206, each one of the first progressive jackpots that has been allocated a portion of the wager is incremented, such that the eligible player(s) for that progressive jackpot can visually identify the incrementing on a display device for the gaming machine (or other gaming machines linked into the same progressive jackpots). Next, at step S208, the values of a second set of progressive jackpots are incremented based on the values of the incremented first progressive jackpots. Again, each eligible player(s) visually identifies the incrementing of the second set of progressive jackpots on the display device of the gaming machine (or other gaming machines linked into the same progressive jackpots).

After receipt of the wager from the player, the wagering game is conducted and, as part of that process, there is a determination of whether a progressive jackpot has been triggered (e.g., progressive symbol or symbol combination is achieved, or a player's wager causes a jackpot to exceed its randomly selected trigger-award threshold value), as noted in step S210. If no progressive jackpot has been triggered, then there is no other aspect of the progressive game to be analyzed with respect to that particular game play. On the other hand, if the progressive jackpot has been triggered, then there is a determination (and/or possibly a selection) of which progressive jackpot has been triggered/awarded, as generally shown at step S212. If the triggered jackpot is one or more of the first progressive jackpots, then that first progressive jackpot(s) is reset to its base reset value at step S214. Additionally, as shown in step S216, a reevaluation of the values of all second progressive jackpots occurs because their values are dictated by the values of the first progressive jackpots. As described above with reference to the embodiment of FIGS. 4-7, the second progressive jackpots can be decreased to a value above their base reset values or to their base reset values, depending on which of the first progressive jackpot(s) has been awarded.

Alternatively, if step S212 determines that a second progressive jackpot has been awarded, then the algorithm proceeds to step S218, which causes the second progressive jackpot that has been triggered to be reset to its base reset value. Additionally, at step S220, any first progressive jackpot that serves as a basis for the value of the awarded second progressive jackpot is reset to its base reset value. Then, because the first progressive jackpot that has been reset in step S220 may affect other second progressive jackpots, there is a reevaluation of the values of other second progressive jackpots that were not triggered at step S222. And, to the extent needed, the reevaluation may require a reduction in the values of those other second progressive jackpots.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming system primarily dedicated to playing a regulated casino wagering game providing eligibility to a plurality of progressive jackpots, each progressive jackpot of the plurality having a respective designated reset value, the gaming system comprising:

an electronic input device configured to detect a physical item associated with a monetary value that establishes a credit balance on the gaming system; and game-logic circuitry configured to:

initiate the casino wagering game in response to an input indicative of a wager drawn on the credit balance;

determine an outcome of the casino wagering game;

in response to the outcome awarding a first progressive jackpot of the plurality, reset the first progressive jackpot to its designated reset value and decrease a second progressive jackpot of the plurality to a value greater than its designated reset value, wherein a value of the first progressive jackpot is based on values of two or more other progressive jackpots of the plurality, and wherein a value of the second progressive jackpot of the plurality is based on at least one but less than all of the two or more other progressive jackpots of the plurality; and direct one or more electronic display devices to display the values of the plurality of progressive jackpots resulting from the outcome.

2. The gaming system of claim 1, wherein the amount greater than its designated reset value of the second progressive jackpot corresponds to the values of the at least one but less than all of the two or more progressive jackpots of the plurality.

3. The gaming system of claim 1, wherein the game-logic circuitry is further configured to:

increment a third progressive jackpot of the plurality with a portion of the wager; and in response to incrementing the third progressive, increment both the first and second progressive jackpots based on an incremented value of the third progressive jackpot.

4. The gaming system of claim 1, wherein resetting the first progressive jackpot to its designated reset value causes the two or more other progressive jackpots to reset to their respective designated reset values.

5. The gaming system of claim 1, wherein the reset value of the first progressive jackpot is less than the decreased value of the second progressive jackpot.

6. The gaming system of claim 1, wherein determining the outcome includes directing one or more electronic display devices to display an array of symbol positions containing symbols representing at least a part of the outcome, and wherein an occurrence of predetermined indicia in the array determines which of the jackpots of the first and/or second tier are incremented.

7. A gaming system primarily dedicated to playing a regulated casino wagering game providing eligibility to a plurality of progressive jackpots, each progressive jackpot of the plurality having a respective designated reset value, the gaming system comprising:

an electronic input device configured to detect a physical item associated with a monetary value that establishes a credit balance on the gaming system; and game-logic circuitry configured to:

initiate the casino wagering game in response to an input indicative of a wager drawn on the credit balance;

determine an outcome of the casino wagering game;

in response to the outcome awarding a first progressive jackpot of the plurality, reset the first progressive jackpot to its designated reset value and decrease a second progressive jackpot of the plurality to a value greater than its designated reset value, wherein the reset value of the first progressive jackpot is greater than the decreased value of the second progressive jackpot; and direct one or more electronic display devices to display the values of the plurality of progressive jackpots resulting from the outcome.

8. A method of operating a plurality of progressive jackpots via a gaming system, each of the plurality having a respective designated reset value, the gaming system including game-logic circuitry and an electronic input device configured to detect a physical item associated with a monetary value that establishes a credit balance on the gaming system, the method comprising:

initiating, via the game-logic circuitry, a casino wagering game in response to an input indicative of a wager drawn on the credit balance;

determining, via the game-logic circuitry, an outcome of the casino wagering game;

in response to the outcome awarding a first progressive jackpot of the plurality, resetting, via the game-logic circuitry, the first progressive jackpot to its designated reset value and decreasing a second progressive jackpot of the plurality to an amount greater than its designated reset value, wherein a value of the first progressive jackpot is based on values of two or more other progressive jackpots of the plurality, and wherein a value of the second progressive jackpot of the plurality is based on at least one but less than all of the two or more other progressive jackpots of the plurality; and directing, via the game-logic circuitry, one or more electronic display devices to display the values of the plurality of progressive jackpots resulting from the outcome.

9. The method of claim 8, wherein the amount greater than its designated reset value of the second progressive jackpot corresponds to the values of the at least one but less than all of the two or more progressive jackpots of the plurality.

10. The method of claim 8, further comprising:

incrementing, via the game-logic circuitry, a third progressive jackpot of the plurality with a portion of the wager; and in response to incrementing the third progressive, incrementing, via the game-logic circuitry, both the first and second progressive jackpots based on an incremented value of the third progressive jackpot.

11. The method of claim 8, wherein resetting the first progressive jackpot to its designated reset value causes the two or more other progressive jackpots to reset to their respective designated reset values.

12. The method of claim 8, wherein the reset value of the first progressive jackpot is less than the decreased value of the second progressive jackpot.

13. A method of operating a plurality of progressive jackpots via a gaming system, each of the plurality having a respective designated reset value, the gaming system including game-logic circuitry and an electronic input device configured to detect a physical item associated with a monetary value that establishes a credit balance on the gaming system, the method comprising:

initiating, via the game-logic circuitry, a casino wagering game in response to an input indicative of a wager drawn on the credit balance;

determining, via the game-logic circuitry, an outcome of the casino wagering game;

in response to the outcome awarding a first progressive jackpot of the plurality, resetting, via the game-logic circuitry, the first progressive jackpot to its designated reset value and decreasing a second progressive jackpot of the plurality to an amount greater than its designated reset value, wherein the reset value of the first progressive jackpot is greater than the decreased value of the second progressive jackpot; and directing, via the game-logic circuitry, one or more electronic display devices to display the values of the plurality of progressive jackpots resulting from the outcome.

14. A gaming system primarily dedicated to playing a regulated casino wagering game including a plurality of progressive jackpots having respective designated reset values, the gaming system comprising:

an electronic input device configured to detect a physical item associated with a monetary value that establishes a credit balance on the gaming system; and game-logic circuitry configured to:

initiate the casino wagering game in response to an input indicative of a wager drawn on the credit balance;

determine an outcome of the casino wagering game;

direct one or more electronic display devices to display values associated with a first tier and a second tier of the plurality of progressive jackpots, the second tier including a first jackpot having a value based on a summation of values of a first set of at least two jackpots of the first tier, the second tier including a second jackpot having a value based on a summation of values of a second set of at least two jackpots of the first tier, the second set including at least one but not all of the at least two jackpots of the first set;

increment at least one of the at least two jackpots in the first set of the first tier with a portion of the wager and recalculate the value of the first jackpot based, at least in part, on the value of the incremented one jackpot of the first tier;

in response to the outcome awarding the first jackpot, reset the first jackpot and the first set of at least two jackpots of the first tier to their respective designated reset values and decrease the second jackpot of the plurality to an amount greater than its designated reset value; and direct one or more electronic display devices to display the reset and recalculated values of the progressive jackpots of the first and second tiers.

15. The gaming system of claim 14, wherein determining an outcome includes directing one or more electronic display devices to display an array of symbol positions containing symbols representing at least a part of the outcome, and wherein an occurrence of predetermined indicia in the array determines which of the jackpots of the first and/or second tier are incremented.

16. The gaming system of claim 14, wherein the game-logic circuitry is further configured to direct one or more electronic display devices to display values associated with a third tier of the plurality of progressive jackpots, the third tier including a major jackpot having a value based on a summation of the values of the first jackpot and the second jackpot.

17. The gaming system of claim 16, wherein the game logic circuitry is further configured to, in response to the outcome awarding the major jackpot, reset the major jackpot, the first jackpot, and the second jackpot to their respective designated reset values.

* * * * *